US011564041B2

(12) United States Patent
Pawlowski et al.

(10) Patent No.: US 11,564,041 B2
(45) Date of Patent: Jan. 24, 2023

(54) DIGITAL TRANSDUCER INTERFACE SCRAMBLING

(71) Applicant: Knowles Electronics, LLC, Itasca, IL (US)

(72) Inventors: Andrzej Pawlowski, Virum (DK); Henrik Thomsen, Holte (DK); Rene Rye Larsen, Bagsvaerd (DK)

(73) Assignee: Knowles Electronics, LLC, Itasca, IL (US)

( * ) Notice: Subject to any disclaimer, the term of this patent is extended or adjusted under 35 U.S.C. 154(b) by 105 days.

(21) Appl. No.: 17/283,460

(22) PCT Filed: Oct. 8, 2019

(86) PCT No.: PCT/US2019/055221

§ 371 (c)(1),
(2) Date: Apr. 7, 2021

(87) PCT Pub. No.: WO2020/076846

PCT Pub. Date: Apr. 16, 2020

(65) Prior Publication Data

US 2022/0014855 A1 Jan. 13, 2022

Related U.S. Application Data

(60) Provisional application No. 62/743,498, filed on Oct. 9, 2018.

(51) Int. Cl.
*H04R 19/04* (2006.01)
*H04R 1/04* (2006.01)
(Continued)

(52) U.S. Cl.
CPC ..... *H04R 19/04* (2013.01); *H04R 1/04* (2013.01); *H04R 3/00* (2013.01); *H04R 19/005* (2013.01); *H04R 2201/003* (2013.01)

(58) Field of Classification Search
CPC . H04R 19/04; H04R 1/04; H04R 3/00; H04R 19/005; H04R 2201/003
See application file for complete search history.

(56) References Cited

U.S. PATENT DOCUMENTS 7,190,038 B2 3/2007 Dehe et al.
7,473,572 B2 1/2009 Dehe et al.
(Continued)

OTHER PUBLICATIONS

International Search Report and Written Opinion issued in International Application No. PCT/US2019/055221 dated Feb. 5, 2020, 9 pages.

(Continued)

*Primary Examiner* — Angelica M McKinney
(74) *Attorney, Agent, or Firm* — Foley & Lardner LLP

(57) ABSTRACT

The present disclosure relates to an integrated circuit connectable to a microelectromechanical system (MEMS) transducer. The MEMS transducer is configured to generate a transducer audio signal in response to sound. The integrated circuit comprises a digital scrambling circuit coupled to a data communication interface. The digital scrambling circuit is configured to convert a digital audio stream, representative of the transducer audio signal, into a corresponding scrambled data stream. The integrated circuit additionally comprises a data bus interface coupled to the digital scrambling circuit and configured to output the scrambled data stream.

19 Claims, 4 Drawing Sheets

(51) Int. Cl.
*H04R 3/00* (2006.01)
*H04R 19/00* (2006.01)

(56) References Cited

U.S. PATENT DOCUMENTS

| | | | | |
|---|---|---|---|---|
| 7,781,249 | B2 | 8/2010 | Laming et al. | |
| 7,795,695 | B2 | 9/2010 | Weigold et al. | |
| 7,825,484 | B2 | 11/2010 | Martin et al. | |
| 7,829,961 | B2 | 11/2010 | Hsiao | |
| 7,856,804 | B2 | 12/2010 | Laming et al. | |
| 7,903,831 | B2 | 3/2011 | Song | |
| 8,170,244 | B2 | 5/2012 | Ryan et al. | |
| 8,400,361 | B2 | 3/2013 | Rofougaran | |
| 9,094,741 | B2 | 7/2015 | Phelps et al. | |
| 9,282,406 | B2 | 3/2016 | Bogason et al. | |
| 9,343,455 | B2 | 5/2016 | Gueorguiev et al. | |
| 9,866,938 | B2 * | 1/2018 | Popper | H04R 1/04 |
| 10,158,943 | B2 | 12/2018 | Conklin et al. | |
| 10,559,293 | B2 | 2/2020 | Thomsen et al. | |
| 2003/0059060 | A1 * | 3/2003 | Eastty | H04R 1/04 381/95 |
| 2005/0207605 | A1 | 9/2005 | Dehe et al. | |
| 2007/0278501 | A1 | 12/2007 | Macpherson et al. | |
| 2008/0175425 | A1 | 7/2008 | Roberts et al. | |
| 2008/0267431 | A1 | 10/2008 | Leidl et al. | |
| 2008/0279407 | A1 | 11/2008 | Pahl | |
| 2008/0283942 | A1 | 11/2008 | Huang et al. | |
| 2009/0001553 | A1 | 1/2009 | Pahl et al. | |
| 2009/0180655 | A1 | 7/2009 | Tien et al. | |
| 2009/0232338 | A1 | 9/2009 | Song | |
| 2010/0046780 | A1 | 2/2010 | Song | |
| 2010/0052082 | A1 | 3/2010 | Lee et al. | |
| 2010/0092020 | A1 | 4/2010 | Ryan et al. | |
| 2010/0128914 | A1 | 5/2010 | Khenkin | |
| 2010/0183181 | A1 | 7/2010 | Wang | |
| 2010/0246877 | A1 | 9/2010 | Wang et al. | |
| 2010/0290644 | A1 | 11/2010 | Wu et al. | |
| 2010/0322443 | A1 | 12/2010 | Wu et al. | |
| 2010/0322451 | A1 | 12/2010 | Wu et al. | |
| 2011/0013787 | A1 | 1/2011 | Chang | |
| 2011/0075875 | A1 | 3/2011 | Wu et al. | |
| 2014/0177113 | A1 | 6/2014 | Gueorguiev et al. | |
| 2014/0177874 | A1 | 6/2014 | Bogason et al. | |
| 2017/0077911 | A1 | 3/2017 | Badillo et al. | |
| 2017/0164118 | A1 | 6/2017 | Wiesbauer et al. | |
| 2017/0223455 | A1 | 8/2017 | Conklin et al. | |
| 2018/0027338 | A1 * | 1/2018 | Shajaan | H04R 19/005 381/113 |
| 2019/0080680 | A1 | 3/2019 | Thomsen et al. | |
| 2019/0345026 | A1 | 11/2019 | Furst et al. | |

OTHER PUBLICATIONS

U.S. Appl. No. 14/504,2017, filed Oct. 1, 2014, Abed et al.
U.S. Appl. No. 17/091,344, filed Nov. 6, 2020, Raminder et al.
U.S. Appl. No. 61/739,284, filed Dec. 19, 2012, Gueorguiev et al.
U.S. Appl. No. 61/940,122, filed Feb. 14, 2014, Ryan.

* cited by examiner

300

400

DIGITAL TRANSDUCER INTERFACE SCRAMBLING

CROSS-REFERENCE TO RELATED PATENT APPLICATION

This application is a National Stage Application of PCT/US2019/055221, filed Oct. 8, 2019, which claims the benefit of and priority to U.S. Provisional Patent Application No. 62/743,498, filed Oct. 9, 2018, the entire contents of which is incorporated by reference herein.

BACKGROUND

Today's portable communication device typically comprises a plurality of digital microphone assemblies, such as two, four or even more microphone assemblies, that are coupled to a shared data bus via standardized data communication interfaces. The respective data streams of the plurality of digital microphone assemblies are written onto the shared data bus in accordance with the relevant communication protocol using a time-division scheme. A digital microprocessor or digital signal processor (DSP) of the portable communication device typically comprises a corresponding standardized data communication interface for receipt of the time-multiplexed data streams generated by the plurality of digital microphone assemblies. The plurality of digital microphone assemblies is concurrently operating to convert respective incoming sounds to corresponding audio data stream. The digital microprocessor or DSP of the portable communication device functions as a bus master and serves to decode the time-division multiplexed audio data stream on the shared data bus and convert the audio data stream into the original digital microphone signals. The original digital microphone signals represent the incoming sounds on the digital microphone assemblies. The digital microprocessor or DSP of the portable communication device is typically configured or programmed to manipulate the plurality of original digital microphone signals to create various desirable enhancements to the incoming sound such as beamforming, noise suppression, feedback cancellation etc.

However, the inventors have realized that the connection of multiple digital microphone assemblies onto the shared data bus leads to certain pronounced drawbacks. One of these drawbacks is that the structured data stream outputted to the shared data bus by a first digital microphone assembly negatively influences the functionality and/or performance of another, second, digital microphone assembly coupled to the shared data bus and vice versa. Hence, a detrimental cross-modulation exists between the first and second digital microphone assemblies and this problem tends to grow with an increasing number of digital microphone assemblies connected to the shared data bus.

The writing on the structured data stream onto the shared data bus by of the digital microphone assembly may create other types of undesirable side effects in a complete multi-microphone system and a portable communication device hosting the complete multi-microphone system. These problems are at least partly created because the spectral content of the structured data stream of a particular digital microphone assembly is highly correlated with the content of the transmitted data. The power spectrum of the structured data stream, as well as current consumption from the power supply of the digital microphone assembly, conveyed by a Pulse Density Modulated (PDM) encoded audio signal is highly correlated with the audio signal itself. In addition, noise-shaped PDM signals, which typically are generated by oversampled and noise-shaped ADC circuits of the digital microphone assembly, comprise high-frequency spectral components under, and at, one-half of the sampling frequency of the ADC. The sampling frequency of the ADC may be above 2 MHz for a typical digital microphone assembly. These high-frequency spectral components, and in general all spectral components of high amplitude, are often a source of interference problems or EMI problems at other types of electronic circuitry of the portable communication device.

All types of digital transducer devices, including the above-discussed digital microphone assemblies, may specify:

1) A certain level of exposure compliance to incoming EMI noise mechanisms, e.g. expressed as PSRR or as RF exposure tolerance level etc.

2) A certain EMI emission level. The latter may entail a guaranteed maximum level of RF emission under specified/standardized conditions such as PCB board setup, bus length, trace widths etc.

BRIEF DESCRIPTION OF THE DRAWINGS

The foregoing and other features of the present disclosure will become more fully apparent from the following description and appended claims, taken in conjunction with the accompanying drawings. These drawings depict only several embodiments in accordance with the disclosure and are, therefore, not to be considered limiting of its scope. Various embodiments are described in more detail below in connection with the appended drawings.

DETAILED DESCRIPTION

Figure 1:
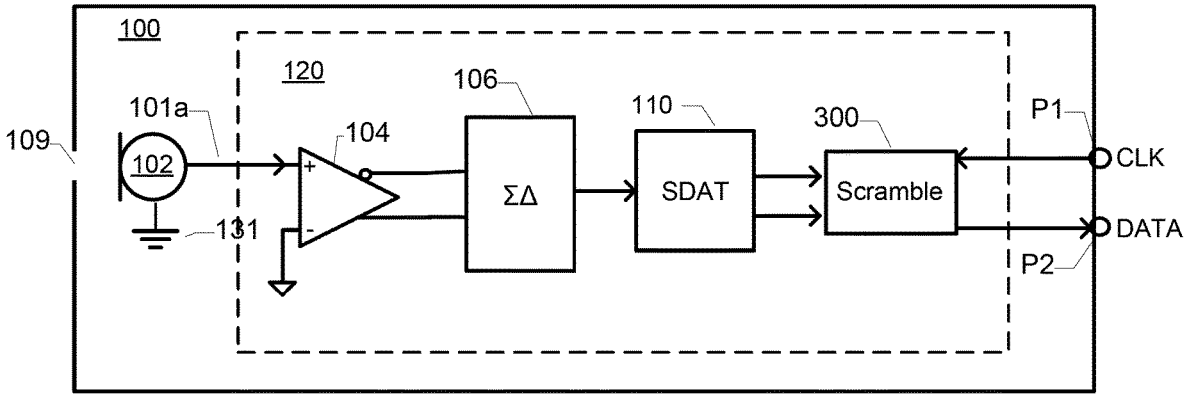
FIG. 1 is a block diagram of an example miniature digital microphone assembly including a MEMS transducer element coupled to signal processing electronics of an integrated circuit, according to some embodiments.

In the following a detailed description, various embodiments are described with reference to the appended drawings. The skilled person will understand that the accompanying drawings are schematic and simplified for clarity and therefore merely show details which are essential to the understanding of the present disclosure, while other details have been left out. Like reference numerals refer to like elements or components throughout. Like elements or components will therefore not necessarily be described in detail with respect to each figure. It will further be appreciated that certain actions and/or steps may be described or depicted in a particular order of occurrence while those skilled in the art will understand that such specificity with respect to sequence is not actually required.

A first aspect of the disclosure relates to an integrated circuit connectable to a microelectromechanical systems (MEMS) transducer that is configured to generate a transducer audio signal in response to sound. The integrated circuit includes an input terminal connectable to an output of the MEMS transducer; an analog-to-digital converter (ADC) coupled to the input terminal and configured to generate a corresponding digital audio stream by sampling and quantizing the transducer audio signal when the integrated circuit is connected to the MEMS transducer; an analog-to-digital converter (ADC) coupled to the input terminal and configured to generate a corresponding digital audio stream by sampling and quantizing the transducer audio signal when the integrated circuit is connected to the MEMS transducer; a data communication interface coupled to an output of the ADC and configured to convert the digital audio stream into a structured data stream in accordance with a predetermined data protocol; a digital scrambling circuit coupled to the data communication interface and configured to transform the structured data stream into a corresponding scrambled data stream; and a data bus interface coupled to the digital scrambling circuit and configured to output the scrambled data stream.

A second aspect of the disclosure relates to a microphone assembly that includes a housing and a MEMS transducer element disposed in the housing and configured to convert sound into a transducer audio signal at a transducer output. The microphone assembly further includes an integrated circuit connectable to the MEMS transducer and including an input terminal connected to the transducer output for receipt of the transducer audio signal; an analog-to-digital converter (ADC) coupled to the input terminal and configured to generate a corresponding digital audio stream by sampling and quantizing the transducer audio signal when the integrated circuit is connected to the MEMS transducer; a data communication interface coupled to an output of the ADC and configured to convert the digital audio stream into a structured data stream in accordance with a predetermined data protocol; a digital scrambling circuit coupled to the data communication interface and configured to transform the structured data stream into a corresponding scrambled data stream; and a data bus interface coupled to the digital scrambling circuit and configured to output the scrambled data stream. The microphone assembly further includes an external device interface comprising a plurality of contacts disposed on a surface of the housing, wherein the data bus interface of the integrated circuit is coupled to the plurality of contacts.

A third aspect of the disclosure relates to a multi-microphone system including a shared data bus, a first microphone assembly, a second microphone assembly, a master processor, and a communication interface. The first microphone assembly includes a first housing; a first MEMS transducer element disposed in the first housing and configured to convert sound into a first transducer audio signal at a transducer output of the first MEMS transducer element; and a first integrated circuit connectable to the first MEMS transducer. The first integrated circuit includes a first input terminal connected to the transducer output of the first MEMS transducer element for receipt of the first transducer audio signal; a first analog-to-digital converter (ADC) coupled to the first input terminal and configured to generate a corresponding first digital audio stream by sampling and quantizing the first transducer audio signal when the first integrated circuit is connected to the first MEMS transducer; a first data communication interface coupled to an output of the first ADC and configured to convert the first digital audio stream into a first structured data stream in accordance with a predetermined data protocol; a first digital scrambling circuit coupled to the first data communication interface and configured to transform the first structured data stream into a corresponding first scrambled data stream; and a first data bus interface coupled to the first digital scrambling circuit and configured to convey the first scrambled data stream onto the shared data bus. The second microphone assembly includes a second housing; a second MEMS transducer element disposed in the second housing and configured to convert sound into a second transducer audio signal at a transducer output of the second MEMS transducer element; and a second integrated circuit connectable to the second MEMS transducer. The second integrated circuit includes a second input terminal connected to the transducer output of the second MEMS transducer element for receipt of the second transducer audio signal; a second analog-to-digital converter (ADC) coupled to the second input terminal and configured to generate a corresponding second digital audio stream by sampling and quantizing the second transducer audio signal when the second integrated circuit is connected to the second MEMS transducer; a second data communication interface coupled to an output of the second ADC and configured to convert the second digital audio stream into a second structured data stream in accordance with the predetermined data protocol; a second digital scrambling circuit coupled to the second data communication interface and configured to transform the second structured data stream into a corresponding second scrambled data stream, wherein the second scrambled data stream and the first scrambled data stream are uncorrelated; and a second data bus interface coupled to the second digital scrambling circuit and configured to convey the second scrambled data stream onto the shared data bus. The master processor includes a third data bus interface for receiving the first scrambled data stream and the second scrambled data stream from the shared data bus; and a third digital descrambling circuit configured for de-multiplexing and converting, in accordance with one or more descrambling algorithms, the first scrambled data stream and the second scrambled data stream into corresponding structured data streams. The communicate interface is configure to retrieve the first digital audio stream and the second digital audio stream from the structured data streams in accordance with the predetermined data protocol.

The present multi-microphone system markedly reduce the above-addressed EMI emission problems and EMI tolerance or compliance problems associated with prior art multi-microphone system and digital microphone assemblies. The operation of the digital scrambling circuit on the integrated circuit or on the digital microphone assembly modifies or transforms the switching activity on the shared data bus in a desirable manner by whitening or randomizing spectral components of the structured data stream generated by the digital microphone assembly in response to incoming sound. This whitening or randomizing of the spectral components of the structured data stream eliminates, or markedly reduces, the above-mentioned correlation between the data stream and the audio signal itself. In other words, the digital scrambling circuit transforms the structured data stream, such as a PDM encoded stream, into the corresponding scrambled data stream which preferably contains exact the same information, but where the spectral components have been de-correlated with the audio signal itself.

A fourth aspect of the disclosure relates to a method of processing a digital audio stream in an audio signal processing integrated circuit. The method includes receiving a transducer audio signal from a microelectromechanical systems (MEMS) transducer; generating a corresponding digital audio stream by sampling and quantizing the transducer audio signal using an analog-to-digital converter (ADC); converting the digital audio stream into a structured data stream in accordance with a predetermined data protocol of a data communication interface; transforming the structured data stream into a corresponding scrambled data stream; and outputting the scrambled data stream from the audio signal processing integrated circuit via a data bus interface.

The present integrated circuit, digital scrambling circuit and scrambling methodology are effective to eliminate cross-modulation or interference via the shared data bus between individual ones of the plurality of digital microphone assemblies of the multi-microphone system. One mechanism which this achieves this effect is an relatively even dispersion of the spectral components of the scrambled data stream across frequency comparted to the spectral components of the structured data stream such that pronounced spectral peaks of the latter are eliminated. These pronounced spectral peaks are often a source of non-linearity and intermodulation in various components of the multi-microphone system to create the above-mentioned cross-modulation or interference problems between individual ones of the digital microphone assemblies. The cross-modulation tends to reduce important performance metrics of the individual digital microphone assembly such as signal-to noise ratio, PSSR etc.

The digital descrambling circuit which may be integrated on a master device or processor of the present multi-microphone system. The digital descrambling circuit is designed, configured or constructed to reverse the operation of each of the digital scrambling circuits of the plurality of digital microphone assemblies. In this manner, the digital descrambling circuit may initially de-multiplex the plurality of scrambled data streams on the shared data bus and thereafter decode or descramble each of the retrieved scrambled data streams into the corresponding structured data streams in accordance with one or more predetermined descrambling algorithm(s).

Embodiments of the integrated circuit are described in detail below with reference to the appended drawings.

FIG. 1 shows an electrical block diagram of an exemplary miniature digital microphone assembly 100 comprising a MEMS transducer element 102 coupled to signal processing electronics of an integrated circuit 120. The MEMS transducer element 102 may be disposed in a housing 103 (illustrated on FIG. 2). The MEMS transducer element 102 is configured to convert sound into a corresponding transducer audio signal at a transducer output 101*a*. The transducer audio signal may be applied as a single-ended signal or a differential signal to one of both of the inverting and non-inverting input(s) of the microphone preamplifier or transconductance amplifier 104. The integrated circuit 120 may be formed as a separate integrated circuit using sub-micron CMOS technology or any other suitable semiconductor manufacturing technology. The microphone preamplifier 104 receives the transducer audio signal produced by the MEMS transducer element 102. As output, the microphone preamplifier 104 generates a differential current signal or differential voltage signal representative of the transducer audio signal in accordance with the predetermined small-signal voltage amplification or transconductance (gm) of the microphone preamplifier 104. The differential current signal or differential voltage signal is supplied to an input of a voltage-input or current-input analog-to-digital converter (ADC) 106.

The ADC 106 is configured for sampling and quantizing the transducer audio signal to generate a corresponding digital audio stream. The ADC 106 may be of an oversampling type, e.g. having a sampling frequency above 1 MHz or above 3 MHz and adapted to produce a multibit or single-bit digital microphone signal representative of the transducer audio signal depending on the particular converter type. The microphone preamplifier 104 preferably exhibits a large input impedance such as larger than 100 MΩ, such as larger than 1 GΩ.

The digital audio stream supplied at the output of the ADC 106 is provided to the input of a proprietary or industry-standard data communication interface (SDAT) 110 which is configured to convert the digital audio stream into a structured data stream in accordance with a predetermined data protocol. The predetermined data protocol may be a serial data protocol such as so-called legacy PDM, $I^2S$, USB, SoundWire or SPI. The predetermined data protocol may support bi-directional data transmission or unidirectional data transmission. Certain protocols may configured to exclusive transport audio data within the structured data stream, such as the legacy PDM protocol, while other data protocols supports transmission of various types of control information. The standardized data communication interface preferably includes a separate clock line (CLK) that controls the timing of the data of the structured data stream conveyed over a separate and associated data line or wire (DATA) of the interface 110. In one embodiment, the standardized data communication interface 110 also comprises a digital command and control interface which may be configured to receive various types of data commands from a host processor (now shown) of a portable communication device (e.g. a smartphone).

The structured data stream is applied to an input of a digital scrambling circuit 300 from the output of the data communication interface 110. The digital scrambling circuit 300 is configured to transform the structured data stream into a corresponding scrambled data stream in accordance with a multiplicative/self-synchronizing scrambling algorithm or an additive or synchronous scrambling algorithm implemented in the digital scrambling circuit 300 as discussed in additional detail below. The integrated circuit 120 additionally comprises external device interface which may comprise a plurality of contacts or pads P1, P2 mounted on a top surface or bottom surface of the carrier substrate 111. The data bus interface outputs the scrambled data stream on a shared or common data bus (not shown) via the contacts P1, P2 of the external device interface. The data bus interface may comprise various bus-driver circuits. The data bus interface and external device interface allow physical and electrical coupling or connection of the miniature digital microphone assembly 100 to the shared data bus. The shared data bus may comprise a plurality of electrical wires or conductors disposed on a carrier substrate, e.g. a printed circuit board, of the previously discussed portable communication device.

Figure 2:
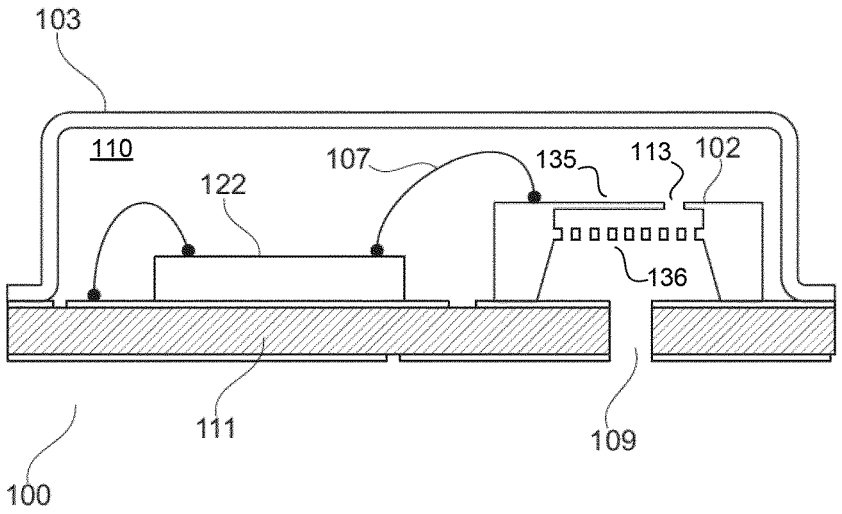
FIG. 2 is a drawing of a lateral cross-sectional view of an exemplary miniature digital microphone assembly, according to some embodiments.

FIG. 2 is a lateral cross-sectional view through the housing of a specific embodiment of the above-discussed miniature digital microphone assembly 100. In the present embodiment, the MEMS transducer element 102 comprises a capacitive sound transducer for capture and conversion of sound signals in the audible range, i.e. a MEMS microphone element. The capacitive MEMS transducer element 102 is configured to convert incoming sound within at least a part of the audible range between 20 Hz and 20 kHz into a corresponding digitally encoded microphone signal. The capacitive MEMS transducer element 102 may, for example, exhibit a transducer capacitance between 0.5 pF and 10 pF. The capacitive transducer element may include first and second mutually charged transducer electrodes, e.g., a diaphragm 135 and back plate 136, respectively, supplying the microphone signal. The charge may be injected onto one of the diaphragm 135 and back plate 136 by an appropriate high-impedance DC bias voltage supply (not shown). Alternatively, the transducer may be a piezoelectric device or some other known or future transducer.

The microphone assembly 100 additionally includes the previously discussed integrated circuit 120, which may include a semiconductor die, for example a mixed-signal CMOS semiconductor device integrating the various analog and digital circuits disclosed herein. The integrated circuit 12 is e.g. shaped and sized for mounting on a substrate or carrier element 111 of the assembly 100, where the carrier element 111 likewise supports the capacitive MEMS transducer element 102. The microphone assembly 100 includes a housing which comprises a lid 103 mounted onto a peripheral edge of the substrate or carrier element 111 such that the lid 103 and carrier element 111 jointly form a microphone housing enclosing and protecting the transducer element 102 and the integrated circuit 120 from contaminants of the external environment such as dust, moisture, heat, EMI signals. The microphone housing 103 may include a sound inlet or sound port 109 projecting through the carrier element 111, or through the lid 103 in other embodiments, for conveying sound waves to the MEMS transducer element 102.

The MEMS transducer element 102 generates the previously discussed transducer audio signal at a transducer output (see e.g. item 101*a* of FIG. 1) in response to impinging sound. The transducer output may for example include a pad or terminal of the MEMS element 102 that is electrically coupled to the processing circuit 122 via one or more bonding wires 107. The processing circuit 122 may be similar to, the same as, or may include integrated circuit 120.

Figure 3:
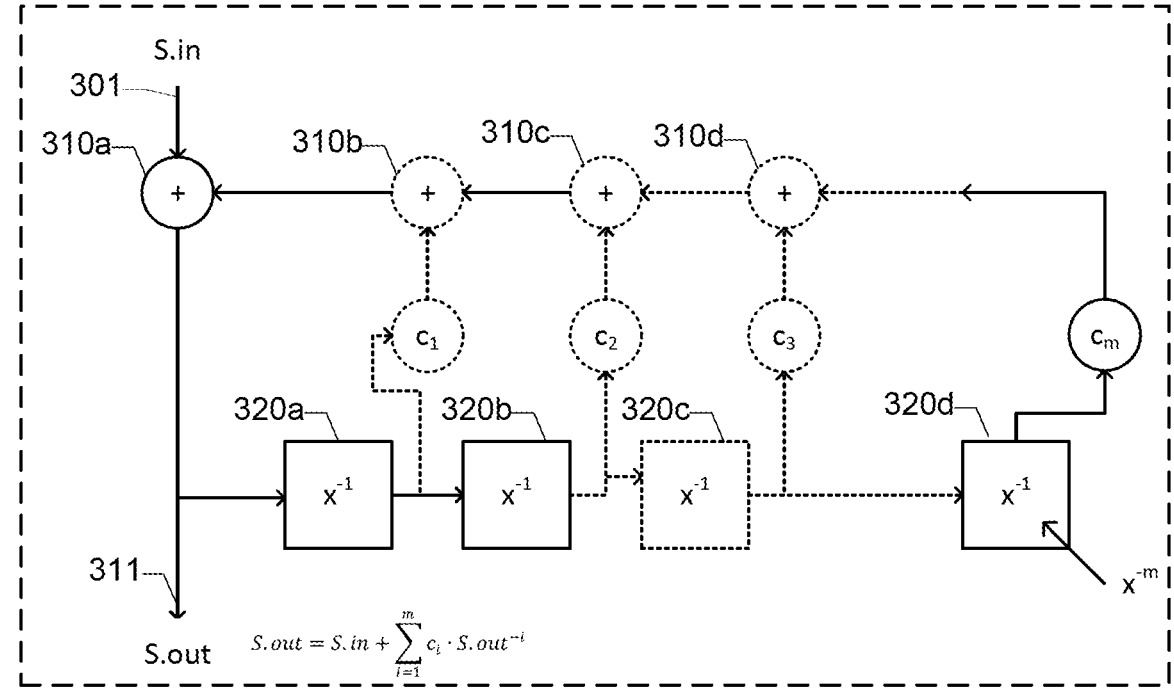
FIG. 3 shows a simplified block diagram of an exemplary digital scrambling circuit of an integrated circuit of the exemplary miniature digital microphone assembly, according to some embodiments.

FIG. 3 shows a simplified block diagram of an exemplary digital scrambling circuit 300 of the integrated circuit 120 of the miniature digital microphone assembly 100. The digital scrambling circuit 300 is configured to execute or implement a multiplicative or self-synchronizing scrambling algorithm accordance with a predetermined z-domain transfer function to the structured data stream S.in applied at the input node 301 of the digital scrambling circuit 300. The digital scrambling circuit 300 produces the corresponding scrambled data stream S.out at the output node 311. The predetermined z-domain transfer function is preferably defined by a maximum length irreducible polynomial, h(x), in accordance with $h(x)=x^m+c_{m-1}\cdot x^{m-2}+\ldots+1$; wherein m is a positive integer, e.g. a positive integer between 8 and 40. The digital scrambling circuit 300 comprises a plurality of digital XOR gates 310*a*, 310*b*, 310*c*, 310*d*, a plurality of digital flop-flop circuits 320*a*, 320*b*, 320*c*, 320*d* and coefficient memory elements $c_1$, $c_2$, $c_3$ and $c_m$.

The z-domain transfer function is defined by the listed equation:

$$S.\text{out}=S.\text{in}+\Sigma_{i+1}^{m}c_i\cdot S.\ \text{out}^{-i}.$$

The skilled person will appreciate that each of the digital flop-flop circuits 320*a*, 320*b*, 320*c*, 320*d* is operated in accordance with a clock signal and therefore provides a unit-delay to its input signal while each of the digital XOR gates 310*a*, 310*b*, 310*c*, 310*d* implements a digital multiplication function so as to, in combination with coefficient memory elements c1, c2, c3 and cm jointly implement the chosen z-domain transfer function. The length of the maximum length irreducible polynomial, h(x), can be freely selected, within practical constraints, via the value of the positive integer m where the order of the polynomial is the highest value of m for which c_m=1. A given implementation will have a finite number of coefficient memory elements each with value {0, 1}.

The skilled person will understand that alternative embodiments of the digital scrambling circuit 300 of the integrated circuit 120 may include an additive or synchronous scrambling or encoding algorithm configured for encoding the structured data stream in accordance with a pseudorandom binary sequence (PRBS). The additive or synchronous scrambling algorithm may for example be based on a linear-feedback shift register (LFSR) possessing a predetermined polynomial and a predetermined initial state.

Figure 4:
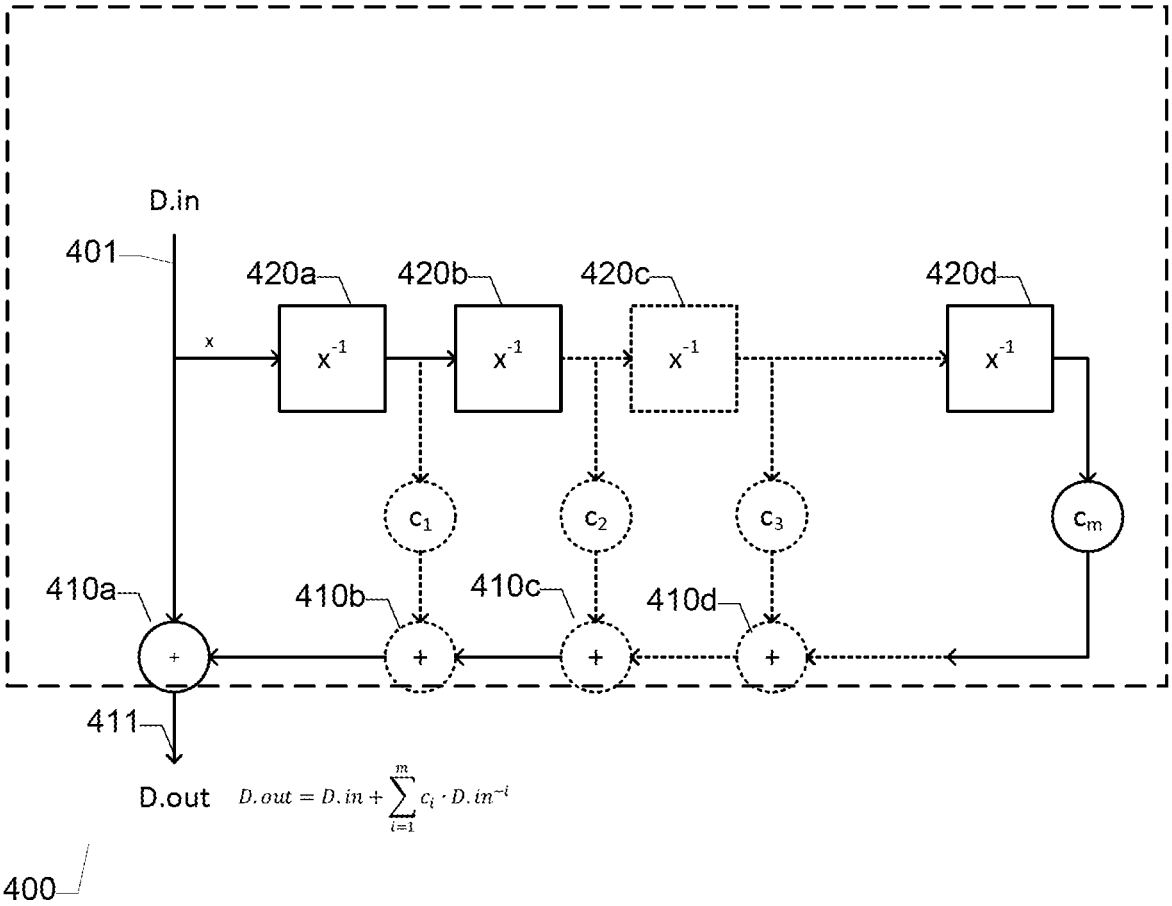
FIG. 4 shows a simplified block diagram of an exemplary digital descrambling circuit, according to some embodiments.

FIG. 4 shows a simplified block diagram of an exemplary digital descrambling circuit 400 of the integrated circuit 120 of the miniature digital microphone assembly 100. The digital descrambling circuit 400 is configured to execute or implement a multiplicative or self-synchronizing descrambling algorithm which is the inverse of the above-discussed digital scrambling algorithm carried out by the digital scrambling circuit 300 discussed above. The scrambled data stream of a particular digital microphone D.in applied at the input node 401 of the digital descrambling circuit 400 and the corresponding structured data stream D.out of the digital microphone in question is recovered or decoded at the output node 411 of the digital descrambling circuit 400.

The digital descrambling circuit 400 comprises a plurality of digital XOR gates 410*a*, 410*b*, 410*c*, 410*d*, a plurality of digital flop-flop circuits 420*a*, 420*b*, 420*c*, 420*d* and coefficient memory elements $c_1$, $c_2$, $c_3$ and $c_m$.

The z-domain transfer function of the digital descrambling circuit 400 is defined by the listed equation:

$$D.\ \text{out}=D.\ \text{in}+\sum_{i=1}^{m}c_i\cdot D.\ \text{in}^{-i}$$

The skilled person will appreciate that the digital descrambling circuit 400 is self-synchronized due to the multiplicative nature of the combined scrambling and descrambling algorithm carried out by the digital scrambling circuit 300 and digital descrambling circuit 400.

Figure 5:
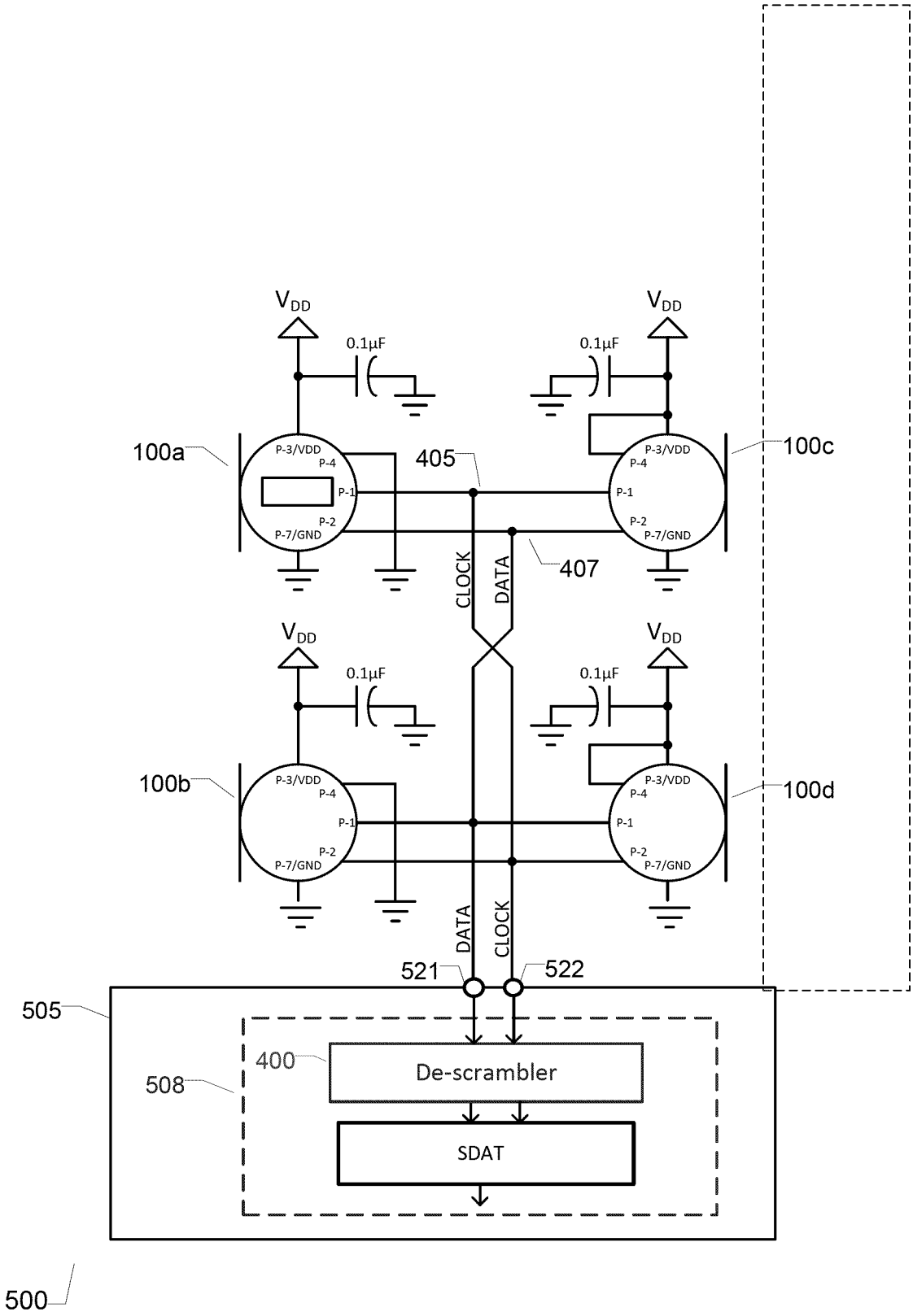
FIG. 5 shows a simplified block diagram of an exemplary multi-microphone system including a plurality of miniature digital microphone assemblies coupled to a shared data bus, according to some embodiments.

FIG. 5 shows a simplified block diagram of an exemplary multi-microphone system 500 comprising a four miniature digital microphone assemblies 100*a*, 100*b*, 100*c*, 100*d* coupled to a shared data bus comprising a clock wire 405 and a data wire 407. The skilled person will appreciate that other embodiments of the system 500 may include fewer, e.g. one, two, or more miniature digital microphone assemblies. The multi-microphone system 500 may be integrated in a portable communication device (not shown) such as a smartphone where the miniature digital microphone assemblies 100*a*, 100*b*, 100*c*, 100*d* are arranged in different physical locations of a housing of the smartphone. Each of the miniature digital microphone assemblies 100*a*, 100*b*, 100*c*, 100*d* may correspond to the above-discussed miniature digital microphone assembly 100. The data bus interface of each miniature digital microphone assembly is electrically coupled or connected to the shared data bus via one or more externally accessible pad(s) or terminal(s) P-1, P-2 e.g. arranged on a carrier of the assembly. Each of the miniature digital microphone assemblies comprises power supply pads or terminals P-3, P7 for receipt of a supply voltage $V_{DD}$ which may lie between 1.5 V and 2.0 V. Each of the miniature digital microphone assemblies may comprise a programming pin P-4 that may set a certain parameter, state or identity, e.g. Left or Right, of the digital microphone assembly by either connecting the P-4 pad to ground or supply voltage $V_{DD}$.

The respective digital scrambling circuits of the four digital microphone assemblies 100*a*, 100*b*, 100*c*, 100*d* are configured to generate uncorrelated scrambled data streams e.g. by introducing a certain phase-shift between their respective scrambling algorithms or by using different polynomial, h(x), functions for the scrambling or conversion of the structured data streams. The phase-shift of the scrambling algorithm of a particular miniature digital microphone assembly may be set by pad/pin programming and use the same pin as P-4 discussed above for assigning a Left or Right identity to the microphone assembly. This is particularly beneficial if the data communication interface of the miniature digital microphone assembly does not support control data exchange, such as a legacy PDM data communication interface. Otherwise, the phase-shift of the scrambling algorithm of the miniature digital microphone assembly may written, e.g. by the host processor, to particular memory register or memory area accessible to the digital scrambling circuit 300. This allows the host processor to control the respective phase-shift settings of the plurality of miniature digital microphone assemblies connected to the shared data bus.

The multi-microphone system 500 comprises a master processor 505 such as the previously discussed digital microprocessor or DSP of the portable communication device. The master processor 505 comprises a bus master circuit 508 which serves to decode the time-division multiplexed audio data stream on the shared data bus. The bus master circuit 508 comprises a bus interface which comprises I/O pads 521, 522 which electrically connects the bus master circuit 508 to the shared data bus. The bus master circuit 508 therefore receives the four scrambled data streams from the shared data bus and initially de-multiplexes the four scrambled data streams to create four separate scrambled data streams corresponding to the four digital microphone assemblies 100*a*, 100*b*, 100*c*, 100*d*. Thereafter, the bus master circuit 508 transforms each scrambled data stream into the corresponding structured data stream by applying an appropriate digital descrambling circuit 400 which is based on the same scrambling algorithm or polynomial, h(x), function as the digital scrambling circuit 300 of the digital microphone assembly in question. Consequently, the digital descrambling circuit 400 may comprise four different descrambling algorithms that are inverse to respective ones of the four scrambling algorithms executed by the four digital scrambling circuits of the digital microphone assemblies. Consequently, the bus master circuit 508 outputs the four structured data streams corresponding to the structured data streams generated by the respective standardized data communication interfaces of the four digital microphone assemblies 100*a*, 100*b*, 100*c*, 100*d* to the standardized data communication interface 504 of the master processor 500. The standardized data communication interface 504 converts the structured data streams into corresponding digital audio signals generated by the four digital microphone assemblies 100*a*, 100*b*, 100*c*, 100*d*. The master circuit 508 may additionally be configured to extract various types of control data from the structured data streams if the data protocol on the shared data bus supports transmission of such control information.

The skilled person will appreciate that the descrambling circuit 400 may be based on dedicated and appropriately configured digital circuit blocks and elements or on software routines or application programs comprising executable microprocessor code. Hence, the descrambling algorithms executed by the digital descrambling circuit 400 may in certain embodiments be carried out by digital circuit blocks and elements as schematically illustrated on FIG. 4. Alternatively, the descrambling algorithms may be carried out by executable microprocessor code executed on the digital microprocessor or DSP of the portable communication device.

Figure 6:
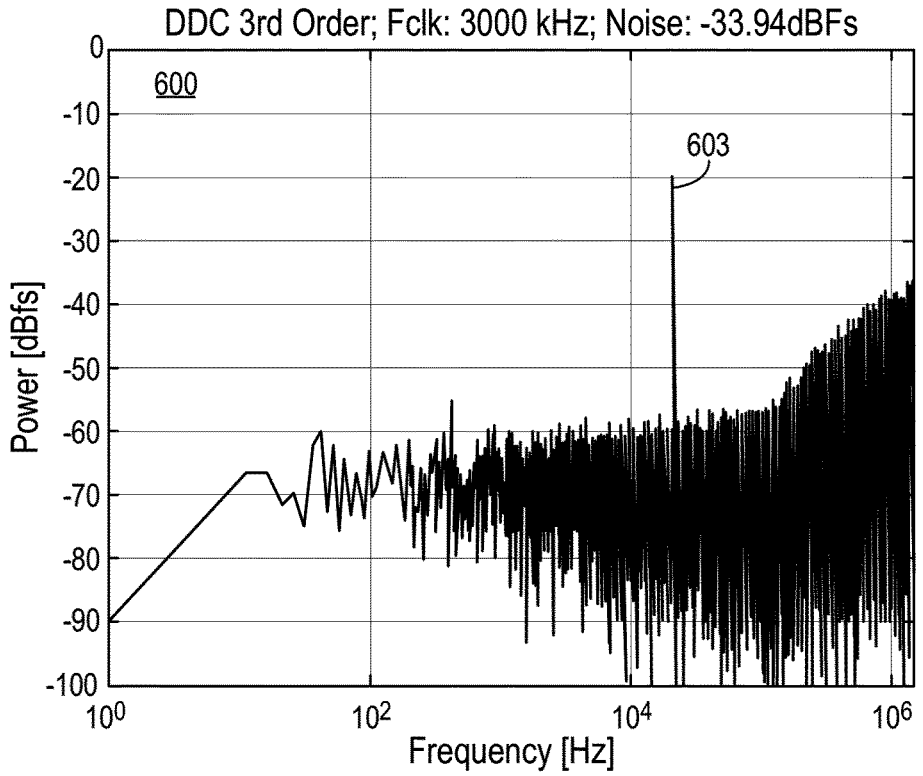
FIG. 6 shows respective frequency spectrum plots of the structured data stream output and scrambled data stream output of the exemplary miniature digital microphone assembly, according to some embodiments.
Figure 6:
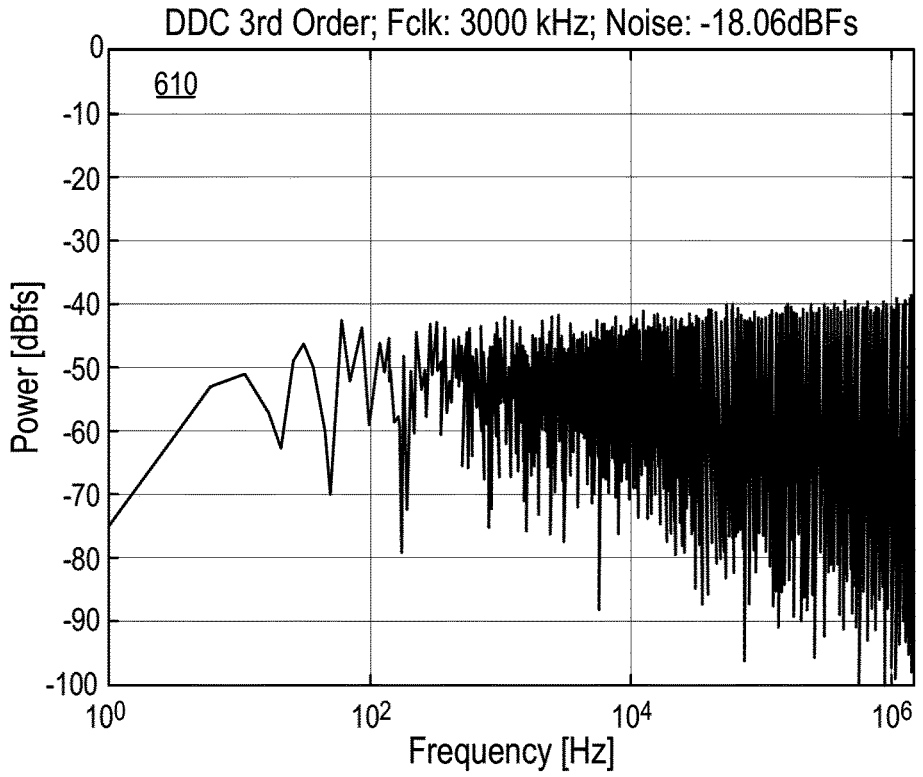

FIG. 6 show illustrates the advantages achieved in the digital microphone assembly by the application of the above-discussed scrambling algorithm and digital scrambling circuit. Plot 600 shows the simulated, via MATLAB, frequency spectrum of an unscrambled data stream produced by the digital microphone assembly in response to a 20 kHz incoming sound pressure with a level at −20 dB relative to full scale. The frequency scale is logarithmic and shows the frequency from 0 Hz to 1.5 MHz. The digital microphone assembly comprises an oversampled and noise-shaped multi-bit ADC with a sampling frequency of 3 MHz to convert the transducer audio signal into a noise-shaped PDM signal. It is evident that the frequency spectrum of the unscrambled data stream shows a pronounced peak at the 20 kHz input tone. The noise-shaping operation of the noise-shaped multi-bit ADC is also evident from the steadily increasing level of noise above 20 kHz. The high level of the spectral peak at 20 kHz may introduce the previously discussed cross-modulation or interference problems between individual ones of the four digital microphone assemblies of the previously discussed multi-microphone system 500.

Plot 610 is a corresponding plot to the plot 600 above, but with the digital scrambling circuit 300 active to produce scrambled or de-correlated data stream output of the digital microphone assembly. The digital scrambling circuit for the present simulation is based on a multiplicative scrambling algorithm with a z-domain transfer function defined by a maximum length irreducible 9th order polynomial, h(x). It is readily apparent that the spectrum of the scrambled data stream has a substantially constant noise level across frequency indicating that the frequency spectrum of the scrambled data stream is essentially white. Hence, the previous spectral peak at 20 kHz generated by the input sound pressure at this frequency is eliminated. Consequently, the operation of the digital scrambling circuit 300 is evidently very effective in whitening the frequency spectrum of the structured data stream delivered by the data communication interface.

What is claimed is:

1. An integrated circuit connectable to a microelectromechanical systems (MEMS) transducer configured to generate a transducer audio signal in response to sound, the integrated circuit comprising:

an input terminal connectable to an output of the MEMS transducer;

an analog-to-digital converter (ADC) coupled to the input terminal and configured to generate a corresponding digital audio stream by sampling and quantizing the transducer audio signal when the integrated circuit is connected to the MEMS transducer;

a data communication interface coupled to an output of the ADC and configured to convert the digital audio stream into a structured data stream in accordance with a predetermined data protocol;

a digital scrambling circuit coupled to the data communication interface and configured to transform the structured data stream into a corresponding scrambled data stream; and a data bus interface coupled to the digital scrambling circuit and configured to output the scrambled data stream.

2. The integrated circuit of claim 1, wherein the data communication interface is configured to transmit and receive bi-directional control information in addition to the digital audio stream.

3. The integrated circuit of claim 1, wherein the data communication interface comprises a standardized serial communication interface comprising at least one of SoundWire, PDM, $I^2S$, SlimBus, or SPI.

4. The integrated circuit of claim 1, wherein the digital scrambling circuit comprises a multiplicative scrambling algorithm or a self-synchronizing scrambling algorithm that encodes the structured data stream in accordance with a predetermined z-domain transfer function.

5. The integrated circuit of claim 4, wherein the predetermined z-domain transfer function comprises a polynomial.

6. The integrated circuit of claim 5, wherein the polynomial comprises a maximum length irreducible polynomial, $h(x)=x^m+c_{m-1}\cdot x^{m-2}+\ldots+1$, and wherein m is a positive integer between 8 and 40.

7. The integrated circuit of claim 1, wherein the digital scrambling circuit comprises an additive scrambling algorithm or synchronous scrambling algorithm that encodes the structured data stream by applying a pseudorandom binary sequence (PRBS).

8. The integrated circuit of claim 7, wherein the pseudorandom binary sequence is based on a linear-feedback shift register (LFSR) possessing a predetermined polynomial and a predetermined initial state.

9. The integrated circuit of claim 1, wherein the data communication interface and the data bus interface comprise at least a data line and a clock line.

10. The integrated circuit of claim 1, further comprising a microphone preamplifier, wherein an input of the microphone preamplifier is connected to the input terminal for receipt of the transducer audio signal, and wherein an input impedance, at 1 kHz, at the input of the microphone preamplifier is at least 100 MΩ.

11. A microphone assembly comprising:

a housing;

a MEMS transducer element disposed in the housing and configured to convert sound into a transducer audio signal at a transducer output;

an integrated circuit connectable to the MEMS transducer, the integrated circuit comprising:

an input terminal connected to the transducer output for receipt of the transducer audio signal;

an analog-to-digital converter (ADC) coupled to the input terminal and configured to generate a corresponding digital audio stream by sampling and quantizing the transducer audio signal when the integrated circuit is connected to the MEMS transducer;

a data communication interface coupled to an output of the ADC and configured to convert the digital audio stream into a structured data stream in accordance with a predetermined data protocol;

a digital scrambling circuit coupled to the data communication interface and configured to transform the structured data stream into a corresponding scrambled data stream; and a data bus interface coupled to the digital scrambling circuit and configured to output the scrambled data stream; and an external device interface comprising a plurality of contacts disposed on a surface of the housing, wherein the data bus interface of the integrated circuit is coupled to the plurality of contacts.

12. A multi-microphone system comprising:

a shared data bus;

a first microphone assembly comprising:

a first housing;

a first MEMS transducer element disposed in the first housing and configured to convert sound into a first transducer audio signal at a transducer output of the first MEMS transducer element; and a first integrated circuit connectable to the first MEMS transducer, the first integrated circuit comprising:

a first input terminal connected to the transducer output of the first MEMS transducer element for receipt of the first transducer audio signal;

a first analog-to-digital converter (ADC) coupled to the first input terminal and configured to generate a corresponding first digital audio stream by sampling and quantizing the first transducer audio signal when the first integrated circuit is connected to the first MEMS transducer;

a first data communication interface coupled to an output of the first ADC and configured to convert the first digital audio stream into a first structured data stream in accordance with a predetermined data protocol;

a first digital scrambling circuit coupled to the first data communication interface and configured to transform the first structured data stream into a corresponding first scrambled data stream; and a first data bus interface coupled to the first digital scrambling circuit and configured to convey the first scrambled data stream onto the shared data bus;

a second microphone assembly comprising:

a second housing;

a second MEMS transducer element disposed in the second housing and configured to convert sound into a second transducer audio signal at a transducer output of the second MEMS transducer element; and a second integrated circuit connectable to the second MEMS transducer, the second integrated circuit comprising:

a second input terminal connected to the transducer output of the second MEMS transducer element for receipt of the second transducer audio signal;

a second analog-to-digital converter (ADC) coupled to the second input terminal and configured to generate a corresponding second digital audio stream by sampling and quantizing the second transducer audio signal when the second integrated circuit is connected to the second MEMS transducer;

a second data communication interface coupled to an output of the second ADC and configured to convert the second digital audio stream into a second structured data stream in accordance with the predetermined data protocol;

a second digital scrambling circuit coupled to the second data communication interface and configured to transform the second structured data stream into a corresponding second scrambled data stream, wherein the second scrambled data stream and the first scrambled data stream are uncorrelated; and a second data bus interface coupled to the second digital scrambling circuit and configured to convey the second scrambled data stream onto the shared data bus;

a master processor comprising:

a third data bus interface for receiving the first scrambled data stream and the second scrambled data stream from the shared data bus; and a third digital descrambling circuit configured for demultiplexing and converting, in accordance with one or more descrambling algorithms, the first scrambled data stream and the second scrambled data stream into corresponding structured data streams; and a communication interface configured to retrieve the first digital audio stream and the second digital audio stream from the structured data streams in accordance with the predetermined data protocol.

13. The multi-microphone system of claim 12, wherein the multi-microphone system is implemented in a portable communication device.

14. A method of processing a digital audio stream in an audio signal processing integrated circuit, the method comprising:

receiving a transducer audio signal from a microelectromechanical systems (MEMS) transducer;

generating a corresponding digital audio stream by sampling and quantizing the transducer audio signal using an analog-to-digital converter (ADC);

converting the digital audio stream into a structured data stream in accordance with a predetermined data protocol of a data communication interface;

transforming the structured data stream into a corresponding scrambled data stream; and outputting the scrambled data stream from the audio signal processing integrated circuit via a data bus interface.

15. The method of claim 14, wherein transforming the structured data stream into the corresponding scrambled data stream comprises using a multiplicative scrambling algorithm or a self-synchronizing scrambling algorithm that encodes the structured data stream in accordance with a predetermined z-domain transfer function.

16. The method of claim 15, wherein the predetermined z-domain transfer function comprises a polynomial.

17. The method of claim 15, wherein the predetermined z-domain transfer function comprises a maximum length irreducible polynomial, $h(x)=x^m+c_{m-1}\cdot x^{m-2}+\ .\ .\ .\ +$, and wherein m is a positive integer between 8 and 40.

18. The method of claim 14, wherein transforming the structured data stream into the corresponding scrambled data stream comprises using an additive scrambling algorithm or a synchronous scrambling algorithm that encodes the structured data stream by applying a pseudorandom binary sequence (PRBS).

19. The method of claim 18, wherein encoding the structured data stream by applying the PRBS comprises encoding the structured data stream by applying the PRBS based on a linear-feedback shift register (LFSR) possessing a predetermined polynomial and a predetermined initial state.

* * * * *